US007343678B2

(12) United States Patent
Bien et al.

(10) Patent No.: US 7,343,678 B2
(45) Date of Patent: Mar. 18, 2008

(54) METHOD AND DEVICE FOR PRODUCTION OF A HOLLOW SECTION

(75) Inventors: Wilfried Bien, Seevetal-Emmelndorf (DE); Michael Halves, Hamburg (DE); Thomas Hülsberg, Buchholz (DE); Uwe Klüssmann, Bispingen (DE); Bernhard Müller, Stade (DE); Holger Nuhn, Schneverdingen (DE); Ralf Pünjer, Seevetal/Fleestedt (DE); Olav Reinhardt, Hamburg (DE); Dirk Riewert, Hamburg (DE); Alfred Riggers, Freetz-Lengenbostel (DE); Thorsten Sterna, Moisburg (DE)

(73) Assignee: Daimler AG, Stuttgart (DE)

( * ) Notice: Subject to any disclaimer, the term of this patent is extended or adjusted under 35 U.S.C. 154(b) by 10 days.

(21) Appl. No.: 11/010,767

(22) Filed: Dec. 13, 2004

(65) Prior Publication Data

US 2005/0160600 A1 Jul. 28, 2005

(30) Foreign Application Priority Data

Dec. 13, 2003 (DE) ..... 103 58 502

(51) Int. Cl.
*B21D 51/16* (2006.01)
*B23P 11/00* (2006.01)

(52) U.S. Cl. ..... 29/890.08; 29/505; 72/414; 72/370.27; 72/341; 72/338

(58) Field of Classification Search ..... 29/505, 29/890.08, 890.148, 890.141; 72/414, 370.27, 72/341, 338

See application file for complete search history.

(56) References Cited

U.S. PATENT DOCUMENTS

| | | | | |
|---|---|---|---|---|
| 2,470,499 | A * | 5/1949 | Lapp | 266/245 |
| 2,556,738 | A * | 6/1951 | Peterson | 29/505 |
| 3,502,357 | A * | 3/1970 | Wagner | 403/205 |
| 3,831,422 | A * | 8/1974 | Moore | 72/340 |
| 3,918,283 | A * | 11/1975 | Kosch et al. | 72/52 |
| 4,370,790 | A * | 2/1983 | Rodaway | 29/890.148 |
| 4,574,553 | A * | 3/1986 | Lisec | 52/658 |
| 6,694,616 | B1 * | 2/2004 | McKenna | 29/890.148 |

FOREIGN PATENT DOCUMENTS

| | | |
|---|---|---|
| DE | 195 48 224 A1 | 6/1997 |
| GB | 525639 | 9/1940 |
| JP | 58 053329 | 3/1983 |

* cited by examiner

*Primary Examiner*—David P. Bryant
*Assistant Examiner*—Sarang Afzali
(74) *Attorney, Agent, or Firm*—Akerman Senterfitt; Stephan A. Pendorf; Yonghong Chen

(57) ABSTRACT

The invention concerns a method and apparatus for production of a hollow section (1) in which a coiled pre-shape of the hollow section (1) is deep drawn from a sheet part, which is pre-bent after a trimming process and coiled into the final shape of hollow section (1). The edges (45) of hollow section (1) lying in the peripheral direction are then joined together in the contact region. In order to improve the joining capability of hollow section (1) to other components in simple fashion, it is proposed that before the coiling process at least one flat site (35) for joining to another component be embossed before the coiling process in a pre-bent region of the hollow section (1).

12 Claims, 6 Drawing Sheets

METHOD AND DEVICE FOR PRODUCTION OF A HOLLOW SECTION

BACKGROUND OF THE INVENTION

1. Field of Invention

The invention concerns a method for production of a hollow section according to the preamble of patent claim 1 and a device for this purpose according to the preamble of patent claim 6.

2. Related Art of the Invention

A generic method and a generic device are known from DE 195 48 224 A1. The hollow section described therein is designed as a tube part with a bypass connector and serves as an exhaust manifold pipe for a vehicle exhaust system. The tube part is deep-drawn from a sheet coil or plate blank in a multipurpose composite die. After subsequent trimming of the deep-drawn shape, a tube part semi-finished product is produced, which corresponds to the finished shape of the tube part end product. This semifinished product is bent and coiled in subsequent process steps in the multipurpose composite die. The finally bent coiled part is then welded to become gas-tight on its edges lying in the peripheral direction. The round-bent tube part, however, is restricted in its joining possibilities to one or more components, since the tube part can only be reliably and securely joined on its ends by plug connections or fillet welds to other components.

SUMMARY OF THE INVENTION

The underlying task of the invention is to modify a generic method so that the joining capability of the hollow section to other components is improved in simple fashion. In addition, an apparatus is to be shown with which this is made possible.

The task is solved according to the invention by the features of patent claim 1 with respect to the method and by the features of patent claim 6 with respect to the device.

An appropriate contact surface for other components on which the component can be reliably fastened is created by embossing according to the invention of a secondary shaped element in the already-bent region before coiling of the preliminary shape to the final shape of the hollow section by a specially chosen contour of the element. Gluing, soldering and penetration joining are conceivable here as joining methods. Because of the possibility of permitting relatively large-surface joining, a large surface and therefore particularly durable joint can be created. The joining capability of the hollow section is therefore substantially improved in simple fashion. It is important here that the secondary shaped element be formed in the pre-bent region of the hollow section, since negligible deformations at best resulting from the coiling process develop there. The embossed secondary shaped element is therefore kept shape-true and contour-true to conclusion of the coiling process. Components that are to be joined to the secondary shaped element with the hollow section can be welded on much more durably by a contour of the secondary shaped element precisely adjusted to it than to a hollow section with unspecified shape. The formation need not necessarily be restricted to a single secondary shaped element; instead several secondary shaped elements can be produced both in the longitudinal direction of the hollow section and in the peripheral direction as long as this occurs in the pre-bent region of the hollow section. The secondary shaped element need not necessarily serve for joining of the hollow section to another component, for example an exhaust manifold with a flange or another exhaust pipe. It can just as well be used as a support for another component or to satisfy appearance or safety engineering aspects in vehicle construction.

In an especially preferred modification of the invention according to claim 2, following embossing, the secondary shaped element is perforated with a corresponding perforation device of the apparatus according to the invention according to claim 7. The hole then advantageously experiences no warping in the subsequent production process of the hollow section, although the hollow section is further deformed by the coiling process so that the hole dimension is retained almost unaffected to the end of the production process. Perforation, for example, is absolutely necessary if the hollow section is to be inserted into an exhaust system and a radial access for a component, which can be an exhaust return line or a lambda probe, is present. In both applications very precise hole dimensions are a precondition to guarantee reliable joining of the line or probe to the hollow section. During embossing of a flat site as secondary shaped element, perforation is also connected with lower expense, since only a hole punch with a flat cutting edge is required, which need not be adjusted as otherwise to the radius of curvature of the hollow section and therefore need not be designed to be relatively complicated.

In another preferred modification of the invention according to claim 3 and according to claim 8, following perforation, the perforation edge region is raised by means of a punch allocated to a corresponding device of the apparatus according to the invention, forming a collar enclosing the hole. By formation of a raised collar, a component to be added onto the hollow section, which is designed as a gas or fluid conducting line, can be mounted in simple fashion onto the collar, during which the line finds a secure stop on the hollow section at the location of the secondary shaped element, especially when formed as a flat site. The hollow section can now be welded to the line. If welding proves to be difficult for any accessibility reasons, the line can also be mounted only over part of the collar so that the line can be simply welded to the collar by a continuous fillet weld. Depending on the length of the raised collar it is also conceivable to join the collar to the line via a sleeve or shell. Simple insertion of the line without welding is also conceivable, forming a small or even large annular gap so that a sliding seat is formed between the hollow section and line.

In a particularly preferred embodiment of the apparatus according to the invention according to claim 10, the perforation device is integrated in the embossing device. By reducing the number of tools by combining two normally separate tools in a single tool, not only are enormous costs saved, but so is time required by the individual tools for the opening and closing movements and the manufacturing time for the hollow section is therefore significantly shortened. In addition, manufacturing tolerances are minimized during production, which can result from transport to another work station and introduction into the tool there.

In another particularly preferred modification of the apparatus according to the invention according to claim 11, the device for raising a collar enclosing the hole is integrated in the embossing device. Advantages resulting from the aforementioned integration are also produced here so that in conjunction with integration of the perforation device in the embossing device, manufacturing tolerances are additionally reduced and production costs and production time are minimized by this further innovation. In addition, the costs for transport logistics are fully eliminated.

In another particularly preferred modification of the invention according to claim 4 and 9, the hollow section is gauged by a gauging device before joining with its edges. Because of this the out-of-roundness forming during prebending is compensated so that the desired target contour of the hollow section is ensured.

In another particularly preferred embodiment of the method according to the invention according to claim 5, the edges of the hollow section are firmly joined to each other via flanges formed after trimming of its preliminary shape by penetration joining. For use of the hollow section as a hot gas-conducting component of an air gap-isolated exhaust manifold the use of penetration joining is particularly favorable, since this joining method can be executed with particular ease and nevertheless guarantees high operating strength of the joint. The fact that the hot gas-conducting internal component of the air gap-isolated exhaust manifold need not necessarily be fully gas tight is also a factor here.

BRIEF DESCRIPTION OF THE DRAWING

The invention is further explained below by means of a practical example depicted in the drawings.

In the drawings.

DETAILED DESCRIPTION OF THE INVENTION

Figure 1:
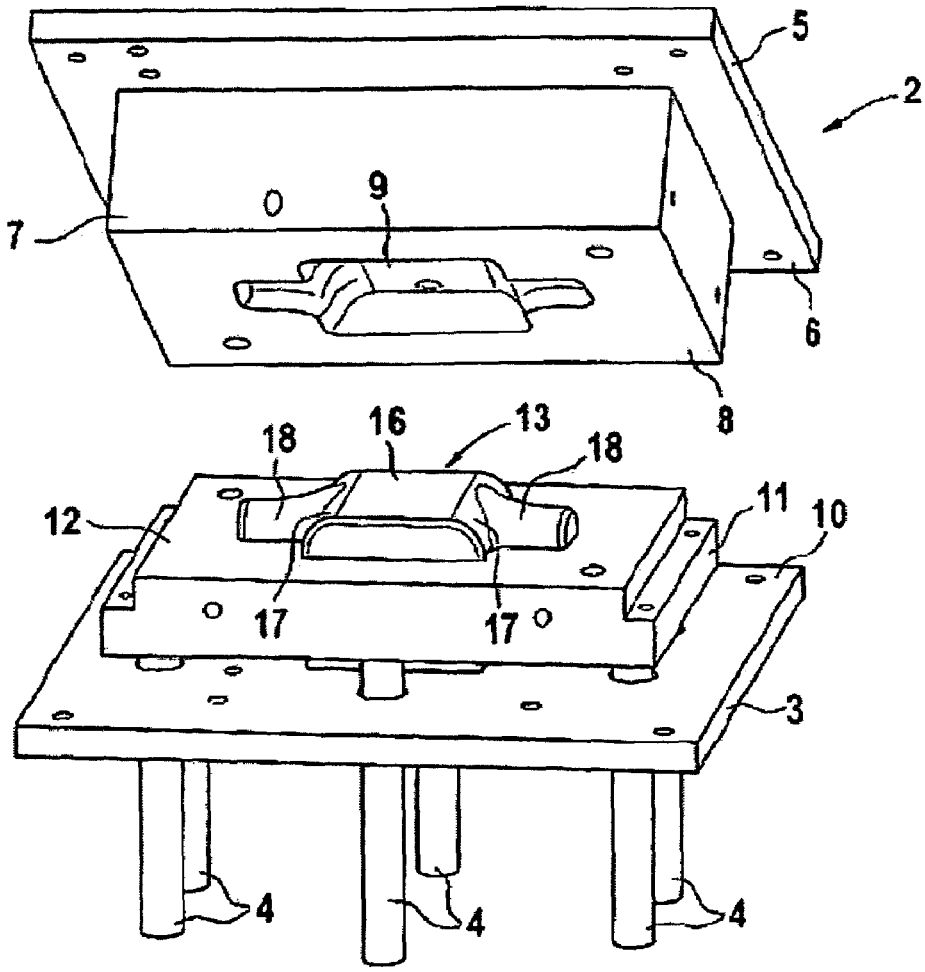
FIG. 1 shows in a perspective view a deep-drawing device of an apparatus according to the invention in the open state.
Figure 2:
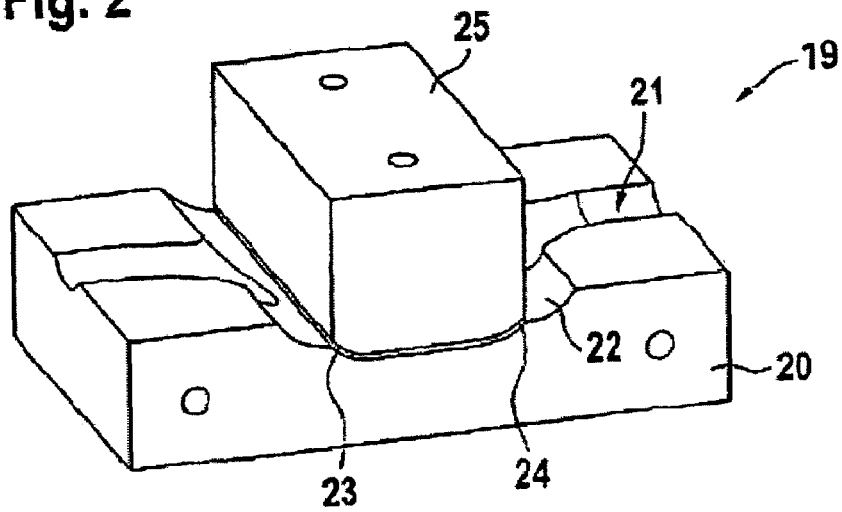
FIG. 2 shows in a perspective view dies of a first bending device of the apparatus according to the invention.

Parts of an apparatus for the production of a hollow section 1 (FIG. 8) are shown in FIGS. 1 to 7, which is formed in a first working step from a flat sheet or a coiled sheet to an unwound pre-shape of the hollow section 1 by deep drawing with a deep-drawing device 2 (FIG. 1). The deep-drawing device 2 consists essentially of a press table 3, which is mounted on several columns 4, and a press head 5 which can be driven hydraulically or pneumatically to make lifting movements. An upper die 7 having a cavity 9 on its bottom 8 whose contour corresponds to the unwound pre-shape of hollow section 1 is arranged on the bottom 6 of the press head. On the top 10 of press table 3 a lower die 11 is fastened whose top 12 has the counter shape 13 to cavity 9. According to the finished pre-shape of hollow section 1, which is formed as a tube piece 14 with a by-pass connector 15 extending radially from it, the counter shape 13 protruding from the top 12 of lower die 11 has an elongated flat center piece 16 that grades or transitions into end pieces 17, viewed in the longitudinal direction, which are bent in the fashion of a quarter circle in cross section by about 90° downward. A half-connector 18 extends in the longitudinal direction of counter shape 13 from each of the end pieces 17, in which the two half connectors 18 form the by-pass connector 15 in the finished hollow section 1.

After deep-drawing of the sheet to said pre-shape of the hollow section 1, this is trimmed in a trimming device that can be arranged separately from the deep-drawing device 2 or integrated in it, in which the caps of the half connector are separated from the pre-shape and the trough-like main part of the pre-shape formed by the center piece 16 and the end pieces 17 is opened by continuous longitudinal sections on both ends lying across the half connector by through longitudinal sections. The separated unusable sheet sections of the pre-form are then disposed of as scrap. The trimmed and formed pre-shape is now removed from the deep-drawing device 2 and fed to a first bending device 19 according to FIG. 2.

Figure 3:
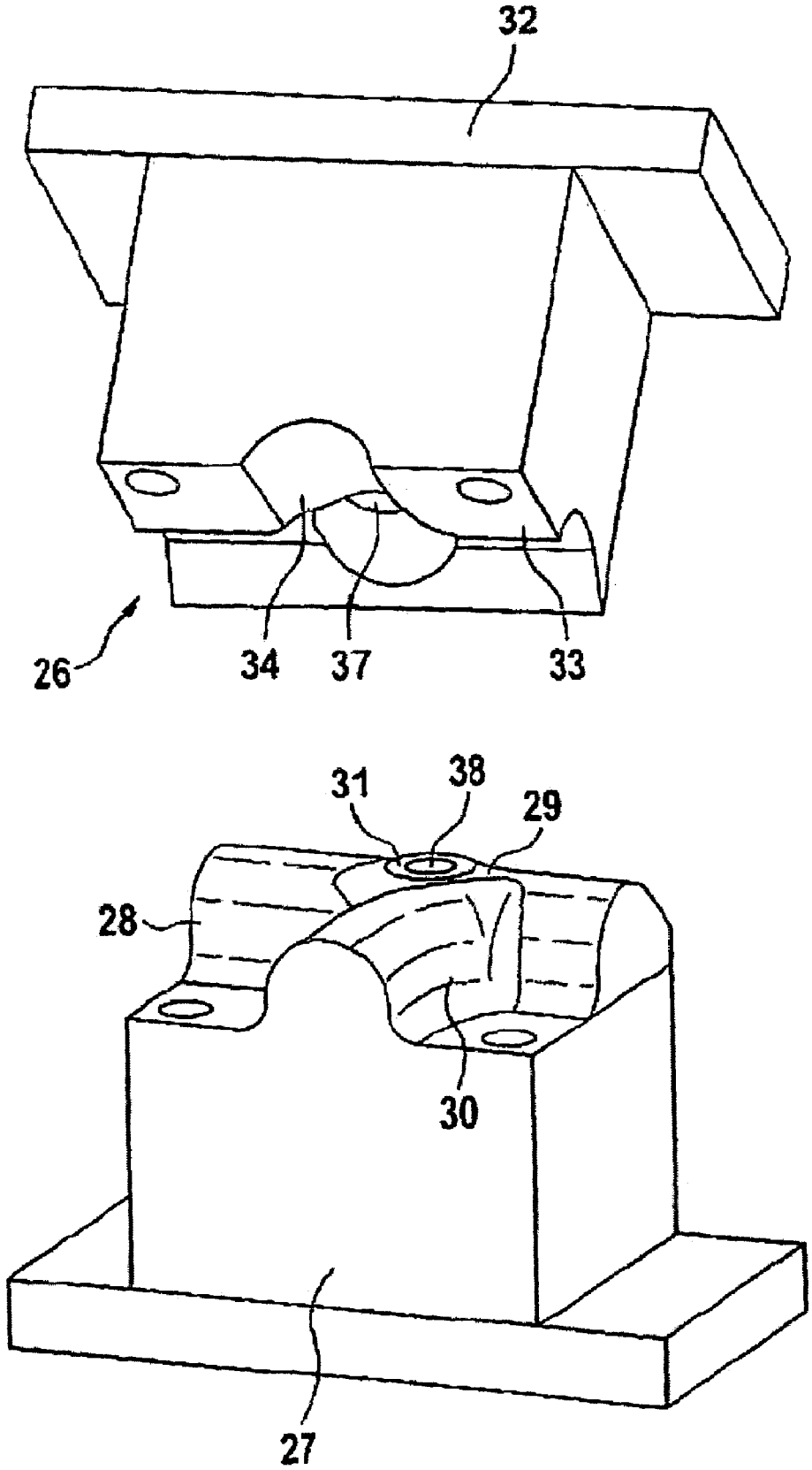
FIG. 3 shows in a perspective view an embossing device of the apparatus according to the invention.
Figure 4:
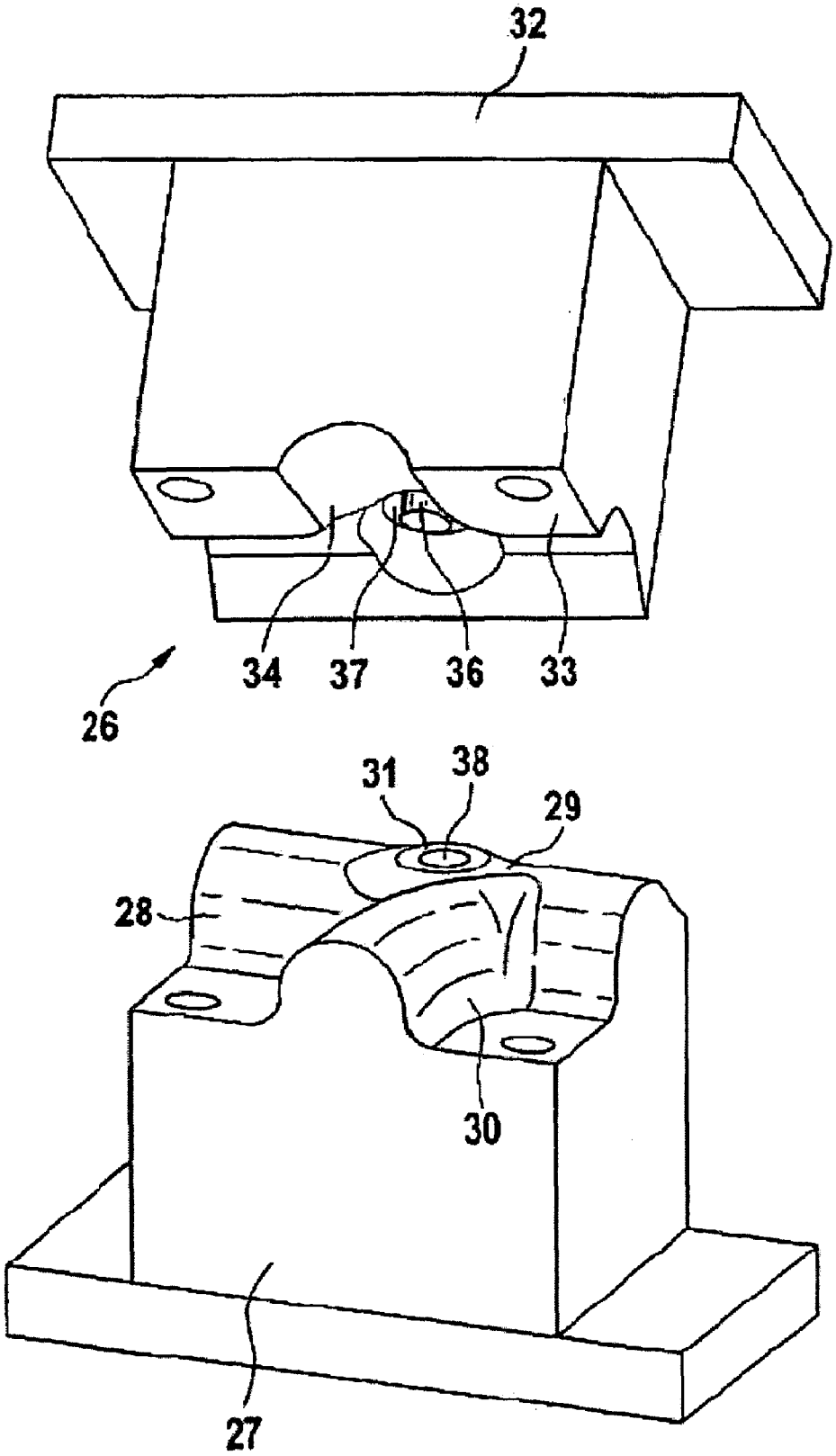
FIG. 4 shows in a perspective view the perforation device of the apparatus according to the invention in the open state.
Figure 5:
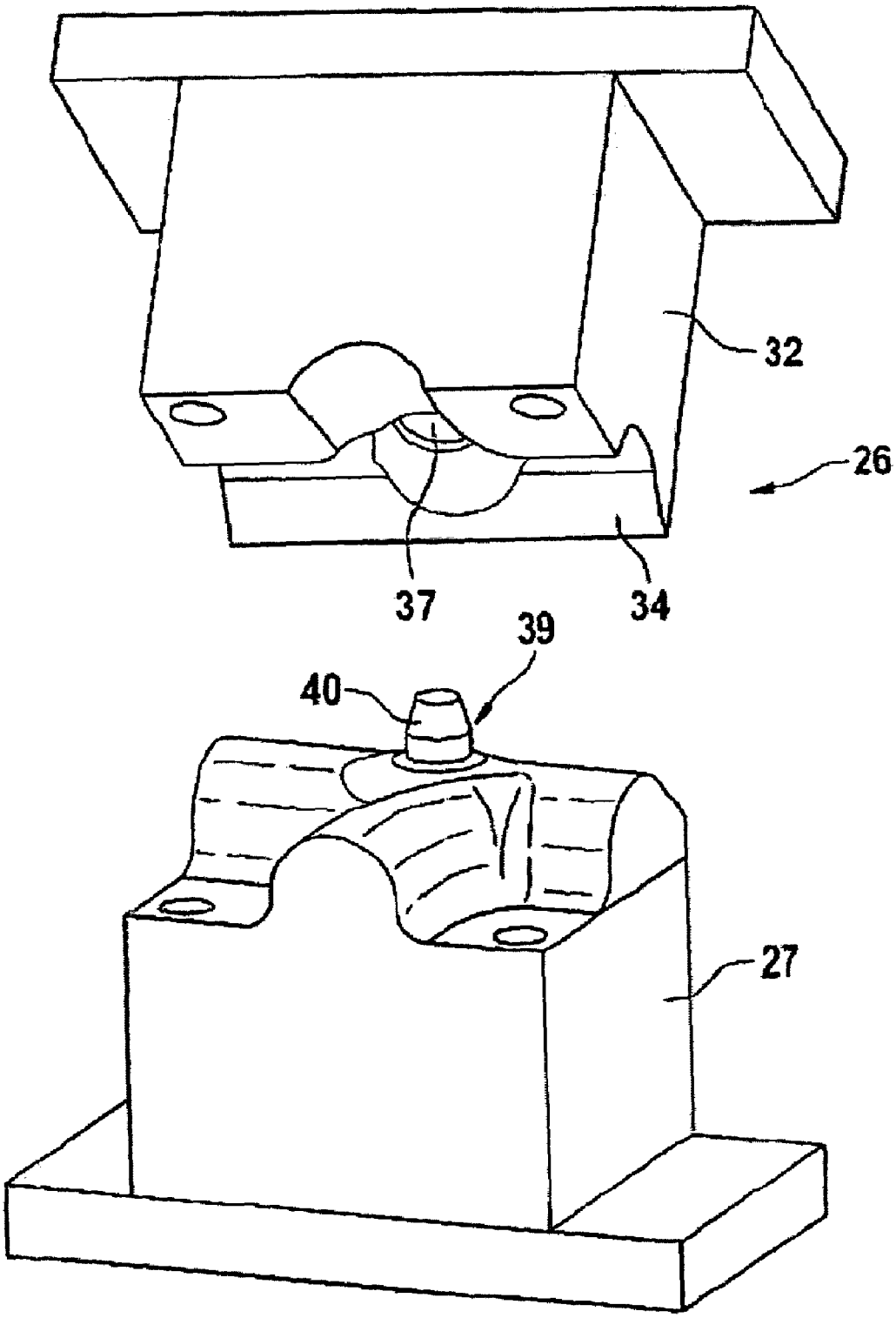
FIG. 5 shows in a perspective view a device of the apparatus according to the invention for raising a collar in the open state.

The first bending device 19 includes a die plate 20 having a cavity or recess 21 into which the deep-drawn and trimmed pre-shape of the hollow section 1 can be inserted. The recess 21 in its center part 22 has a bending radius 23 and 24 over which the inserted pre-shape of hollow section 1, already bent by 90° during deep drawing on both sides of the center piece 16 is bent by 45° in cooperation with a bending punch 25. The half connectors of the pre-shape are already aligned in the direction of the final shape. After bending the center piece 16 of the pre-shape formed from the tube piece 14 is bent by about 270°. The pre-shape so bent is now transferred to an embossing device 26 of the apparatus according to the invention (FIG. 3).

The embossing device 26 contains a lower die 27 with a surface contour 28 that largely corresponds to the pre-bent pre-shape of hollow section 1. In the by-pass region 29 of half connector 30, however, the surface contour has a flat site 31 forming the secondary shaped element according to the invention. The horizontal flat site 31 of the surface contour 28 therefore lies in the pre-bent region of hollow section 1. The embossing device 26 also contains an upper die 32 that carries a cavity 34 on its bottom 33 that corresponds in shape-negative fashion to the surface contour 28 of the lower die 27. After positioning of the pre-bent pre-shape of hollow section 1 on the surface contour 28, the upper die 32, which is driven in a lifting movement, is lowered onto the lower die 27 so that a shape-identical flat site 35 is embossed onto the flat site 31 of the surface contour 28 and the corresponding shape of the cavity 34 on the pre-shape in the same position. The pre-shape at the location of the flat site 35 is then perforated by a perforation device. Although the perforation device can be a work station separate from the embossing device 26, it is an economical advantage in terms of the method if the perforation device is integrated in the embossing device 26, as shown in the present practical example according to FIG. 4.

The perforation device contains a perforation or punching die 36 that is driven in a lifting movement hydraulically or pneumatically or mechanically in a passage 37 formed in the upper die 32 of the embossing device 26. The lower die 27 accordingly has a receiving hole 38 that discharges centrally here on the flat site 31 of surface contour 28. The punched hole separated from the embossed surface site 35 of the pre-shape of hollow section 1 can be withdrawn outward in simple fashion via the receiving hole from the punching die 36. The punching die 36 is also guided so that it is flush with the receiving hole 38, in which it enters the receiving hole 38 during punching. To avoid manufacturing tolerances, after the embossing process, the embossing device 26 remains closed, whereupon perforation is completed by means of the punching die 36 with the closed embossing device 26.

After perforation of the flat site 35 of the pre-shape of the hollow section 1, the hole edge region 39 is raised by means of a device of the apparatus according to the invention containing a punch 40 to form a collar 41 enclosing the hole. It is also conceivable here that the perforated pre-shape is transferred to a separate work station from the embossing device 26 for raising the collar 41. However, this device to form collar 41, as shown in the practical example according to FIG. 5, can also be integrated in the embossing device 26. The punch 40 is guided here within the receiving hole 38 of the lower die 27, in which this is arranged in the receiving hole 38 with limited clearance. In addition, it should further be stated that the diameter of the punching die 36 is smaller than the inside diameter of passage 37, so that an annular gap is formed between it and the punching die. The diameter of the passage 37 is roughly equal to that of the receiving hole 38 so that when the punching die enters the receiving hole 38 a continuous sheet excess remains between its edge and the hole edge, which during raising of the punch 40 forms the collar 41. Formation of the collar 41 also occurs with the embossing device 26 closed so that three different machining processes of the pre-shape of hollow section 1 can occur in short succession in space-saving fashion in a single die in the embossing device 26 closed over the entire machining time. The raised collar 41 then extends perpendicularly in the passage 37 of punching die 36, in which this remains in a retracted position during the raising process.

For the requirements of series production, it can be useful for the working steps embossing, punching and raising the collar 41 to occur in separate dies. This simplifies formation of the dies and prevents a situation in which all three dies must simultaneously be shut down during damage or wear to one die, as would be the case in the aforementioned combination die in which all three dies are integrated.

Figure 6:
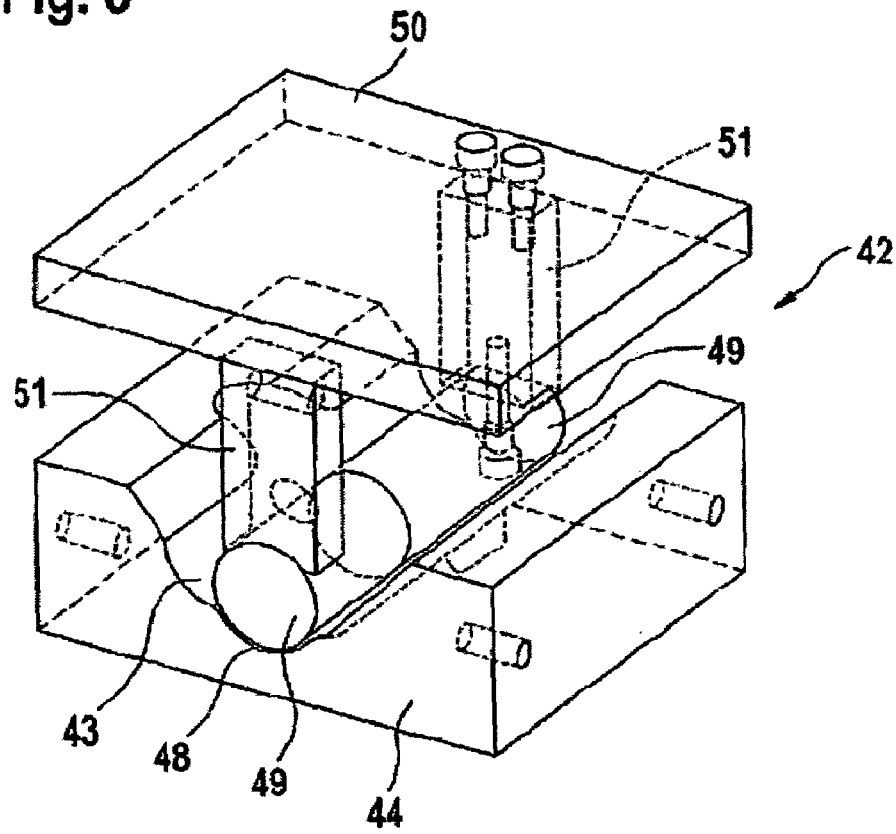
FIG. 6 shows as a sketch in a perspective view a second bending device for bending the pre-bent pre-shape of the hollow section in the closed state.

After opening of the embossing device 26, the embossed, perforated pre-shape provided with a collar 41 of the hollow section 1 is transferred to a second bending device 42 according to FIG. 6. The pre-shape is inserted into a recess 43 of a die plate 44 of the bending device 42, in which the recess 43 has in the center a rounded recess 48 corresponding to the final contour. Thereupon a bending mandrel 49 is introduced axially on both sides into the elongated center part of the pre-shape, which is partially enclosed outside of the pre-shape by a rotational locking block 51 mounted on a head plate 50 that can be lifted. The two mandrels 49 are then lowered so that the pre-shape is pressed into recess 48. The sides of the pre-shape are then raised upward around bending mandrels 49 so that the hollow section 1 is brought into a state close to the final shape because of this coiling process. A state close to the final shape of hollow section 1 means that the pre-shape is bent together around mandrels 49 so that the edges 45 of the hollow section 1 lying in the peripheral direction, i.e. in the coiling direction, are still only spaced from each other by a limited gap. This guarantees that the bending mandrel 49 can be withdrawn again from the bent-together pre-shape without problem. It is also conceivable that the edges 45 lie fully against each other. In order to remove the mandrels 49 from the hollow section 1, the edges 45 are then elastically bent out from each other.

Figure 7:
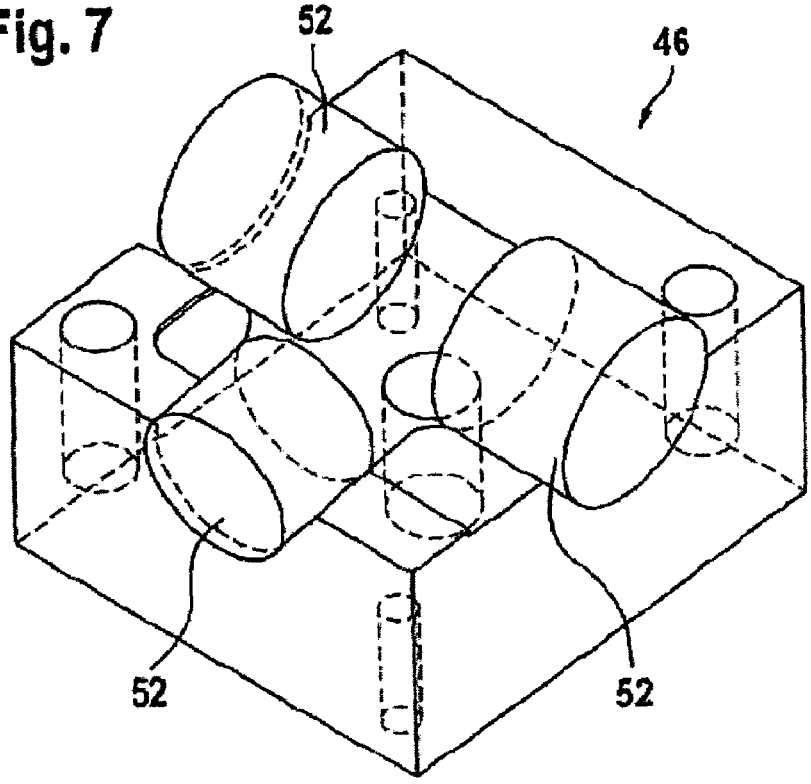
FIG. 7 shows in a sketch a perspective view of a gauging device in the apparatus according to the invention in the closed state.
Figure 8:
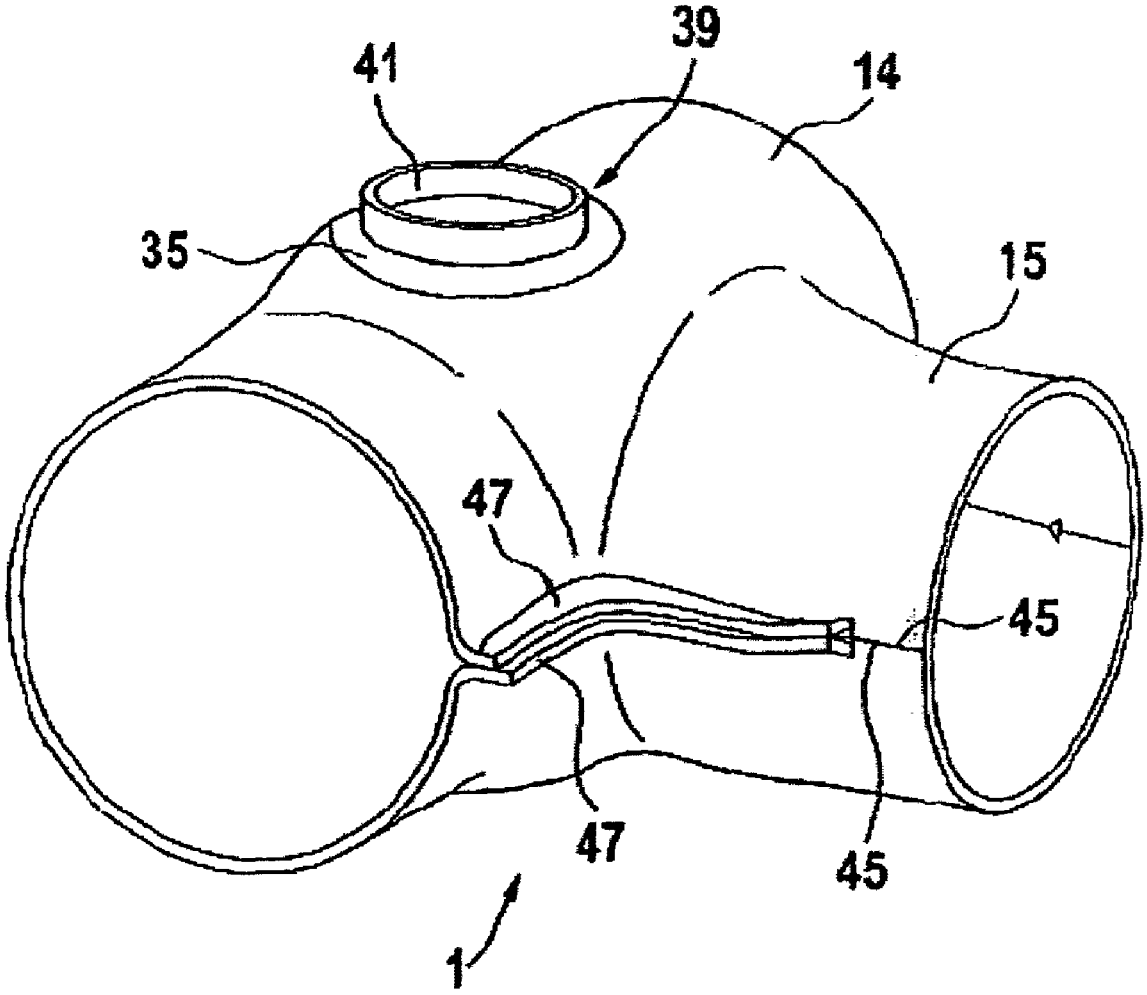
FIG. 8 shows in a perspective view a hollow section finished according to the method of the invention.

The almost finished hollow section 1 is then introduced according to FIG. 7 into a sizing or gauging device 46 of the apparatus in which gauging mandrels 52 are introduced only into the ends of the tube piece 14 and the by-pass connector 15 without completely filling up the hollow section 1. By closing the essentially two-part gauging device 46, the pre-shape of the hollow section 1 is bent together with elimination of the slight gap until the edges 45 either come in contact with each other or overlap. In the second place, out-of-round areas that form from the first bending process, i.e. pre-bending, are compensated. The bent-together pre-shape of the hollow section 1 is then brought to the desired final shape by the gauging device 46 with respect to its contour.

The edges 45 of the hollow section 1 are then joined to each other by means of a joining device. Joining can occur by gluing, welding, soldering or a mechanical clamping technique, preferably by means of penetration joining. For the strength of the joint it is advantageous when the larger contact surface if flanges 47 are formed on the edges 45 of hollow section 1 after trimming of the pre-shape, which are then firmly connected to each other by means of penetration joining. During use of the described hollow section 1 as part of an air gap-isolated exhaust manifold, it is important to realize that the hot gas-guiding parts of the manifold need not necessarily be gas tight. Penetration joining is therefore favored as joining method, since this can be done quickly and simply. It is also conceivable to integrate mechanical clamping by penetration joining, especially TOX joining in the gauging device, which improves the process economy of the overall production method of hollow section 1 and significantly reduces its process time.

It should again be mentioned here that introduction of a flat site 35 in a separate process step by embossing is advantageous over introduction during deep drawing in that a significant part of the entire component has already been pre-shaped before the flat site 35 is introduced. During production of the hollow section 1, during coiling and gauging, deformation of the flat site 35 not supported by a die and deviating only slightly from the target geometry is therefore to be expected. As an alternative to the passage formed in the above practical example of hollow section 1 produced according to the invention, it is also conceivable to provide protrusions or bulges at the location of this flat site without conducting a perforation process. The secondary shaped element formed as flat site 35 here can have a differently embossed contour instead of the flat configuration.

The invention claimed is:

1. A method for production of a hollow section, comprising deep drawing sheet to form an unwound pre-shape of the hollow section, said pre-shape having a center piece and two half-connectors connected to each end of said center piece through a transition part, each of said two half-connectors having a cap, trimming excess material including the caps of the half-connectors, pre-bending said center piece of said pre-shape, embossing at least one secondary shaped element (35) in a pre-bent region of the pre-shape, said secondary shaped element (35) adapted for joining to another component, bending the pre-bent pre-shape into a final wound shape of the hollow section, forming contact regions where edges, lying beneath each other, of the hollow section contact, joining the edges of the hollow section to each other in a peripheral direction in the contact region.

2. The method according to claim 1, wherein the secondary shaped element (35) is perforated in conjunction with embossing, forming a perforation edge region (39).

3. The method according to claim 2, wherein the perforation edge region (39) is raised by means of a punch (40) to form a collar (41) enclosing the perforation in conjunction with said perforation step.

4. The method according to claim 1, wherein the edges (45) of the hollow section (1) are firmly joined via flanges (47) formed after trimming of the pre-shape.

5. The method according to claim 4, wherein the joining is penetration joining.

6. The method according to claim 1, wherein the hollow section (1) is gauged before joining of its edges (45).

7. An apparatus for production of a hollow section, comprising a deep-drawing device for deep drawing of a sheet to an unwound pre-shape of the hollow section, said pre-shape having a center piece and two half-connectors connected to each end of said center piece through a transition part, each of said two half-connectors having a cap, a trimming device for trimming excess material including the caps of the half-connectors, a first bending device for pre-bending said center piece of the pre-shape, an embossing device (26) to emboss at least one secondary shaped element (35) in a pre-bent region of the pre-shape for joining it to another component, a second bending device for bending-together the pre-bent pre-shape into a state at least close to a final shape of the hollow section and forming a contact region where edges of the hollow section contact, and a joining device to join the edges of the hollow section lying in a peripheral direction in the contact region.

8. The apparatus according to claim 7, wherein the apparatus additionally contains a perforation device for perforation of the embossed secondary shaped element (35), forming a perforation edge region (39).

9. The apparatus according to claim 8, wherein the apparatus includes a device containing a punch (40) by means of which the perforation edge region (39) can be raised to form a collar (41) enclosing the perforation.

10. The apparatus according to claim 9, wherein the device for raising a collar (41) enclosing the perforation is integrated in the embossing device (26).

11. The apparatus according to claim 8, wherein the perforation device is integrated in the embossing device (26).

12. The apparatus according to claim 7, wherein the apparatus has a gauging device (46) by means of which the bent-together pre-shape of the hollow section (1) can be brought to the desired final shape with respect to its contour.

* * * * *